US012638015B2

(12) United States Patent
Sykes

(10) Patent No.: US 12,638,015 B2
(45) Date of Patent: May 26, 2026

(54) PERISTALTIC PUMP PRESSURE MEASUREMENT SYSTEM

(71) Applicant: Keymed (Medical & Industrial Equipment) Limited, Southend-on-Sea (GB)

(72) Inventor: Gareth Sykes, Southend-on-Sea (GB)

(73) Assignee: Keymed (Medical & Industrial Equipment) Limited, Southend-on-Sea (GB)

( * ) Notice: Subject to any disclaimer, the term of this patent is extended or adjusted under 35 U.S.C. 154(b) by 20 days.

(21) Appl. No.: 18/442,305

(22) Filed: Feb. 15, 2024

(65) Prior Publication Data

US 2024/0301875 A1 Sep. 12, 2024

Related U.S. Application Data

(60) Provisional application No. 63/450,486, filed on Mar. 7, 2023.

(30) Foreign Application Priority Data

Mar. 8, 2023 (GB) ..... 2303374

(51) Int. Cl.
*F04B 43/12* (2006.01)
*F04B 49/06* (2006.01)
*F04B 51/00* (2006.01)

(52) U.S. Cl.
CPC ..... *F04B 43/1284* (2013.01); *F04B 49/065* (2013.01); *F04B 51/00* (2013.01)

(58) Field of Classification Search
CPC .... F04B 43/12–1292; F04B 49/065–08; F04B 49/20; F04B 51/00; A61M 5/14232
See application file for complete search history.

(56) References Cited

U.S. PATENT DOCUMENTS 3,542,491 A * 11/1970 Newman ..... F04B 43/1253 417/295
5,752,813 A * 5/1998 Tyner ..... F04B 43/1253 417/477.2
7,722,338 B2 * 5/2010 Nordell ..... F04B 43/1253 417/477.2

(Continued)

FOREIGN PATENT DOCUMENTS

CN 105508210 A * 4/2016
CN 108730165 A * 11/2018 ..... F04B 13/00

(Continued)

OTHER PUBLICATIONS

Extended European Search Report dated Aug. 13, 2024 received in 24158853.2.

(Continued)

*Primary Examiner* — Alexander B Comley
(74) *Attorney, Agent, or Firm* — Scully, Scott, Murphy & Presser, P.C.

(57) ABSTRACT

A peristaltic pump including: a rotor, a track, a biasing material configured to resiliently bias the track towards the rotor to compress a flexible tube between the track and the rotor during operation of the pump, and at least one sensor configured to measure movement of the track relative to the rotor during operation of the peristaltic pump and to output a signal indicative of a movement of the tract.

19 Claims, 4 Drawing Sheets

(56) References Cited

U.S. PATENT DOCUMENTS

| | | | | |
|---|---|---|---|---|
| 2005/0053502 | A1* | 3/2005 | Souza | B41J 2/17596 417/477.11 |
| 2012/0082576 | A1* | 4/2012 | Beck | F04B 43/1284 417/474 |
| 2014/0219829 | A1* | 8/2014 | Matsuo | A61M 60/857 417/63 |
| 2015/0159642 | A1* | 6/2015 | Sasa | F04B 43/1253 417/279 |
| 2015/0217040 | A1* | 8/2015 | Matsuo | A61M 60/279 417/477.1 |
| 2019/0293062 | A1* | 9/2019 | Sykes | F04B 43/0081 |
| 2021/0121623 | A1* | 4/2021 | Ujita | F04B 43/12 |
| 2022/0203026 | A1* | 6/2022 | Fischer | G16H 50/20 |
| 2022/0370702 | A1* | 11/2022 | Matovina | G16H 50/20 |

FOREIGN PATENT DOCUMENTS

| | | | | | |
|---|---|---|---|---|---|
| DE | 2358228 | A1 | * | 5/1974 | |
| FR | 854088 | A | * | 4/1940 | |
| GB | 2076476 | A | * | 12/1981 | F04B 43/1253 |
| IT | 102020000026666 | B1 | * | 11/2022 | |
| JP | 2022145482 | A | * | 10/2022 | |
| WO | WO-2018211259 | A1 | * | 11/2018 | A61B 1/015 |
| WO | WO-2022266584 | A1 | * | 12/2022 | A61B 5/0024 |

OTHER PUBLICATIONS

Great Britain Search Report dated Aug. 10, 2023 received in GB2303374.9.

* cited by examiner

PERISTALTIC PUMP PRESSURE MEASUREMENT SYSTEM

CROSS-REFERENCE TO RELATED APPLICATION

The present application is based upon and claims the benefit of priority from U.S. Provisional Application No. 63/450,486, filed on Mar. 7, 2023, the entire contents of which is incorporated herein by reference.

BACKGROUND

Field

The present disclosure relates to peristaltic pumps, and more particularly to peristaltic pumps for use in medical procedures.

Prior Art

Peristaltic pumps are commonly used in medical procedures to supply fluid to a patient. For example, during an endoscopy, fluid may be supplied through an endoscope to irrigate a site in a patient's body which is being observed and to rinse the endoscope lens. To ensure patient safety, and to avoid the risk of damage to the endoscope or other medical equipment, the pressure of the fluid being pumped must be monitored and controlled. However, since the fluid must be maintained in a sterile condition, it is not possible to use a pressure sensor which directly contacts the pumped fluid.

One known method to measure pressure is to incorporate a flexible diaphragm into the tube set through which fluid is being pumped. The flexible diaphragm contacts a sensor on the pump, for example a strain gauge, to detect the fluid pressure. However, this greatly increases the cost of the tube set. The flexible diaphragm may also disrupt or restrict the fluid flow, which may in turn shorten the usable life of the pump head. The addition of a flexible diaphragm also means there are more parts and connections in the tube set which increases the failure risk.

Therefore, there is a need for an improved system for fluid pressure measurement in peristaltic pumps.

SUMMARY

Accordingly, the present disclosure provides a peristaltic pump comprising a rotor, a track, and a biasing device configured to resiliently bias the track towards the rotor to compress a flexible tube between the track and the rotor during operation of the pump, the pump further comprising at least one sensor configured to measure movement of the track relative to the rotor during operation of the pump, and a control system in communication with the sensor and configured to determine fluid pressure in the tube based on movement of the track measured by the sensor.

The present disclosure also provides a method of fluid pressure measurement in a peristaltic pump, the pump having a rotor and a track, the method comprising: resiliently biasing the track towards the rotor to compress a flexible tube between the track and the rotor during operation of the pump, measuring movement of the track relative to the rotor during operation of the pump, determining fluid pressure in the tube based on measured movement of the track.

In this way, the pressure of fluid provided by a peristaltic pump can be measured whilst using a conventional tube set and without contact of the pumped fluid. The useful life of the pump head can be extended by monitoring the pressure of the fluid and adjusting operational parameters of the pump to avoid excessive wear.

BRIEF DESCRIPTION OF THE DRAWINGS

Embodiments will now be described in detail, by way of example only, with reference to the accompanying drawings in which.

DETAILED DESCRIPTION

A peristaltic pump comprises a rotor with one or more independently rotatable rollers mounted thereon, and a track (sometimes called a shoe). In operation a flexible tube is positioned between the track and rotor. As the rotor rotates, each roller compresses the tube, pumping fluid along the tube.

The track and rotor may be mounted on a pump head, which is itself releasably mounted on a pump body. The pump body normally comprises controls for the pump and a drive system to drive the rotor. Alternatively, the track and rotor may be mounted directly on a pump body.

The track is movable in and out of a working position, that is, it is movable away from the rotor to an open position to allow a tube to be fitted (or removed), and towards the rotor to a working position. In the working position a desired spacing between the track and the closest roller is provided which is necessary to squeeze the tube to an extent required to provide a pumping action as the rotor rotates.

In a conventional peristaltic pump, the effectiveness of the pump operation is reliant on the track maintaining a fixed track-to-roller spacing as the rotor rotates. The end of the useful life of a pump head may be indicated by wear on the mechanism for moving the track, which manifests as excess movement of the track relative to the rotor when the track is in the working position and the pump is in operation. This leads to a loss of pressure in the pumped fluid.

In the present disclosure, a peristaltic pump comprises a track which is configured to be movable to a small extent relative to the rotor when it is in the working position. This movement is monitored and used to determine fluid pressure in the tube.

Figure 1:
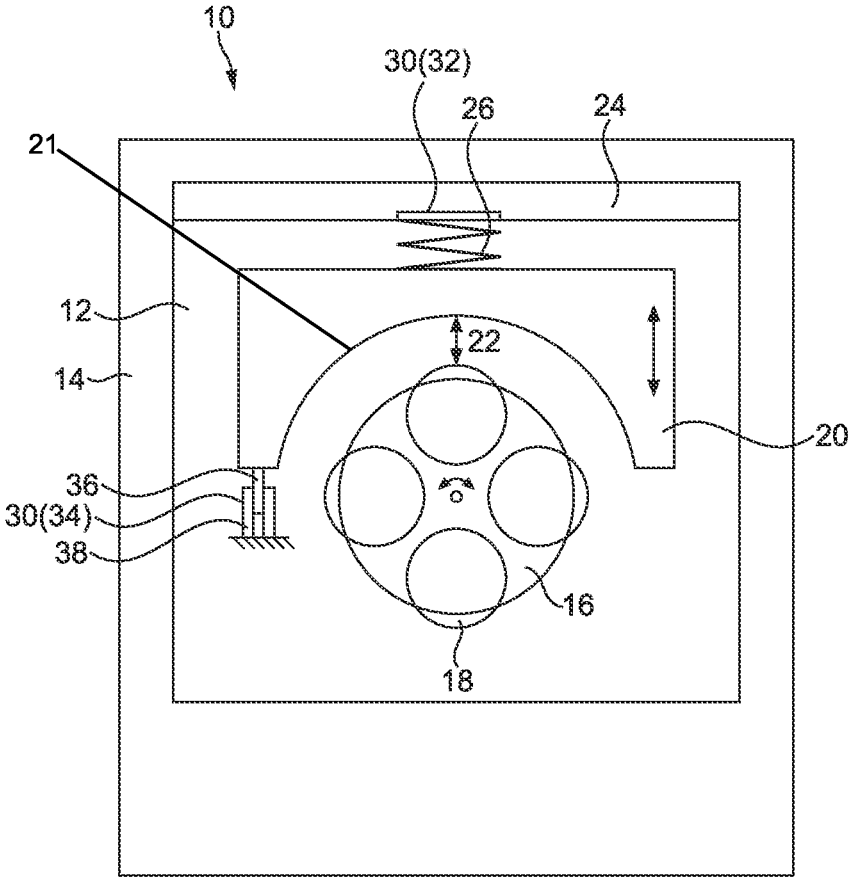
FIG. 1 illustrates a schematically a front view of a peristaltic pump.

FIG. 1 illustrates a peristaltic pump 10, which in this example comprises a pump head 12 releasably mounted on a pump body 14. The Figure is schematic in order to illustrate the main components present, although their precise configuration may vary. The pump head 12 comprises a rotor 16 with rollers 18 mounted thereon, and a track 20. In this example four rollers 18 are shown but fewer or more rollers may be provided. The track 20 comprises a contact surface 21 facing the rotor 16 and the rollers 18. A spacing 22 is defined between the contact surface 21 of the track 20 and the closest roller 18.

Figure 2:
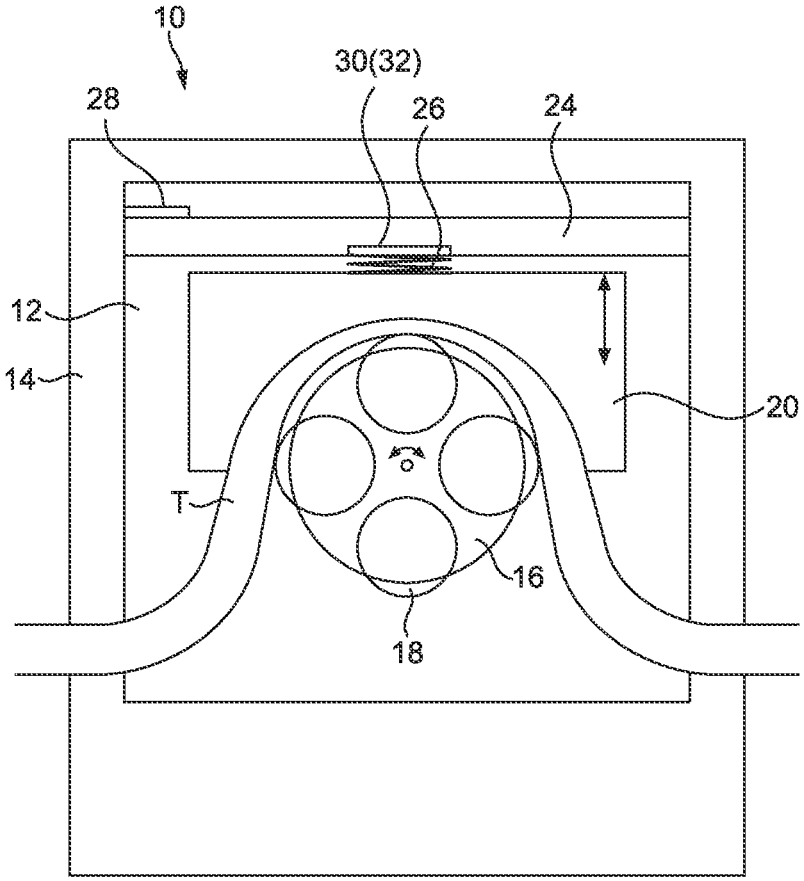
FIG. 2 illustrates the pump of FIG. 1 in a working position, with a tube fitted.

The track 20 is movably mounted on the pump head 12 for movement in and out of a working position. Thus, it can be moved between an open position in which the spacing 22 is a maximum and a working position in which the spacing 22 is a minimum. In this example, the track 20 is movable upwardly away from the rotor 16 to increase the spacing 22 and downwardly towards the rotor 16 to decrease the spacing 22, but other orientations may be used. In the open position the spacing 22 is wide enough to permit a tube T to be fitted to the pump head 12 by positioning it between the track 20 and rotor 16. In the working position, which is shown in FIG. 2, the track 20 is resiliently biased towards the rotor 16, as discussed below, so that the tube T is compressed between the contact surface 21 of the track 20 and the rollers 18 to permit pumping of fluid through the tube T as the rotor 16 rotates.

As is the case in a conventional peristaltic pump, the track 20 may be moved between the open position and the working position by a cover member 24 which is movably mounted on the pump head 12 and is arranged to push the track 20 towards the rotor 16. In the present disclosure, one or more resilient biasing members 26 (generally referred to as a biasing material) are located between the cover member 24 and the track 20. Once the cover member 24 is moved towards the track 20, a retaining mechanism, such as a latch or over-centre cam illustrated schematically as reference 28 in FIG. 2, may hold the cover member 24 in position. The biasing member 26 is compressed between the cover member 24 and the track 20 and urges the track 20 towards the rotor 16. The biasing member 26 may be adjustable, to alter the spring force applied to the track 20. In one example, the biasing member 26 may comprise a spring, adjustable with a grub screw mechanism.

The precise configuration of a mechanism to move the track 20 between the open position and the working position, and to resiliently bias the track 20 in the working position, can be altered as required to suit a given application. For example, while FIG. 2 illustrates one biasing member 26, more than one biasing member may be provided, which may be in different locations. One or more biasing members 26 may comprise a mechanical spring, compressible block, gas spring or any other suitable resilient element.

Thus, in the working position, the track 20 is resiliently biased towards the rotor 16 to provide a desired spacing 22. The spacing 22 is typically approximately equal to twice the wall thickness of the tube T, so that the tube T will be flattened between the track 20 and the closest roller 18, and the spring force will be chosen accordingly. However, if the fluid pressure in the tube T increases above a given threshold, this will push the track 20 against the action of the biasing member 26 and cause the track 20 to move upwardly away from the rotor 16. When the track 20 moves away from the rotor 16, the spacing 22 is increased, the tube T is not compressed by the same amount and the fluid pressure in the tube T will be reduced.

Movement of the track 20 relative to the rotor 16 when the track 20 is in the working position and the pump 10 is in operation is measured by one or more sensors 30. Any suitable type of sensor may be used including, but not limited to, a force gauge, strain gauge, piezoelectric sensor, inductive sensor or optical displacement sensor.

In one embodiment, a sensor 30 comprises at least one strain gauge 32. The strain gauge 32 may be associated with the biasing member 26 mounted between the track 20 and the cover member 24 and arranged to measure force through the biasing member 26.

In another embodiment, a sensor 30 may comprise an inductive sensor such as a linear variable differential transformer (LVDT) 34. An LVDT 34 comprises a core 36 axially movable within a cylindrical winding 38. For example, the core 36 may be mounted on the track 20 and the winding 38 may be mounted in a fixed position on the pump head 12. Movement of the track 20 therefore results in movement of the core 36 relative to the winding 38.

FIG. 1 schematically illustrates both a strain gauge 32 and an LVDT 34 by way of example. For clarity, only a strain gauge 32 is shown in FIG. 2. However, the pump 10 may include only one or more than one sensor 30. If more than one sensor 30 is used, different forms of sensor may be employed. The exact location of the sensor(s) 30 can be altered to suit a given pump design.

Figure 3:
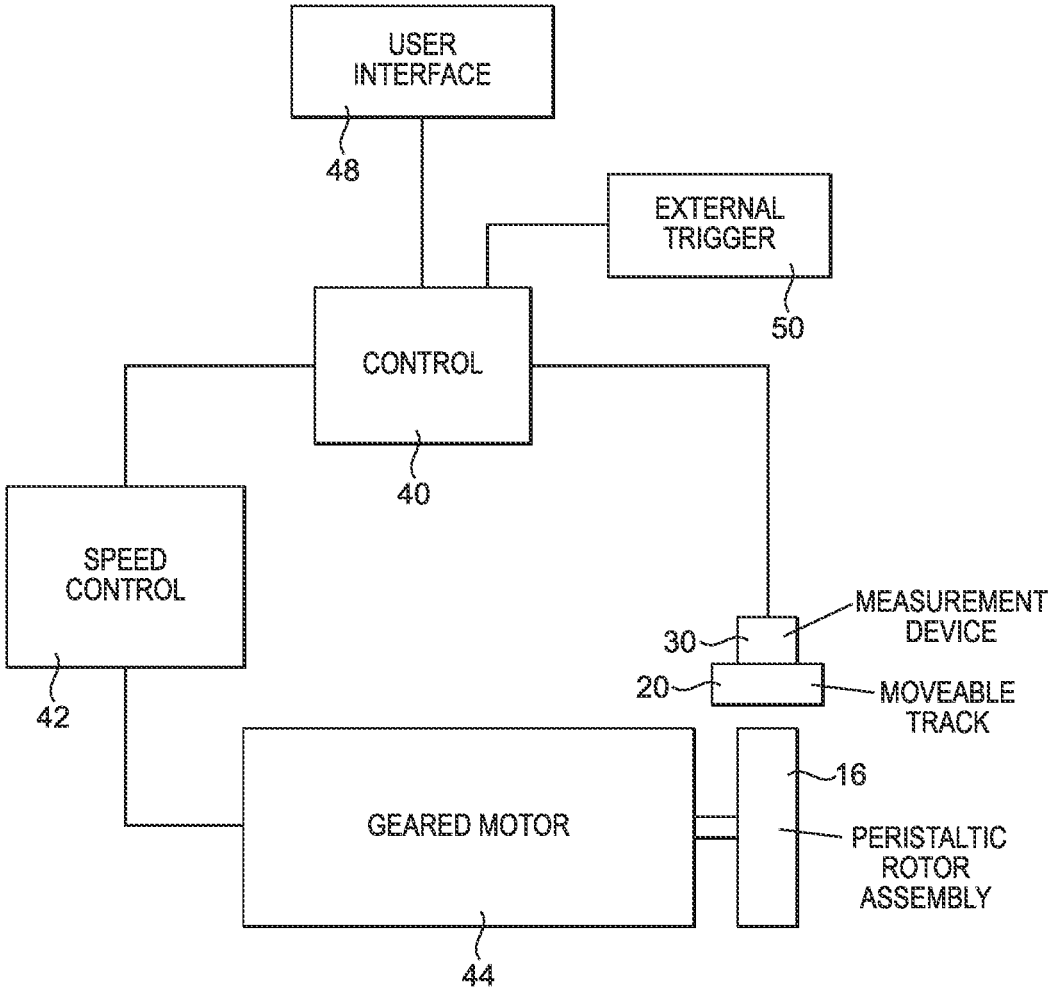
FIG. 3 illustrates schematically a peristaltic pump pressure measurement system.

In use, as illustrated in FIG. 3, the (or each) sensor 30 communicates with a control system 40 to provide data about movement of the track 20. The control system 40 may comprise hardware, such as a processor (such as a CPU, computer or circuit) running software, located in the pump body 14 or externally thereto. The control system 40 is configured to control operational parameters of the pump 10 including the speed of the rotor 16. For example, the control system 40 may communicate with a speed control system 42 which actuates a geared motor 44 which drives the rotor 16.

A user interface 48 may be provided, such as a screen or display providing information to the user and permitting the user to alter operational parameters of the pump 10. An external trigger 50 to switch the pump 10 on and off may also be provided. For example, this may be a footswitch operable by a user.

In response to data from one or more sensors 30, the control system 40 is configured to determine the pressure of fluid in the tube T. The relationship between movement of the track 20 and fluid pressure in the tube T may be determined by prior testing. The relationship may vary with various parameters, such as different types of tube T, different modes of operation of the pump, fluid temperature, external conditions such as ambient temperature and so on. The control system 40 may be preprogramed with information about the relationship between movement of the track 20 and fluid pressure in the tube T for different conditions. The control system 40 may adjust operational parameters such as the rotational speed of the rotor 16 as required to maintain a desired fluid pressure in the tube set. The control system 40 may also provide information about the fluid pressure, pump speed and other parameters to a user via the user interface 48.

Different medical procedures require different patterns of use of a pump 10, with different fluid pressures. For example, in procedures such as an endoscope submucosal dissection (ESD) the pump 10 may be switched on and off multiple times, each for a short duration, and at low speed and thus low pressure. Alternatively, in an endoscopic gastrointestinal procedure (GI), the pump 10 may be operated for a longer duration and at high speed and thus high pressure. The control system 40 may be programmable to run the pump 10 at a predetermined modes of operation to obtain a desired fluid pressure, altering the speed if required in response to data from the sensor 30.

The control system 40 may incorporate the use of an Artificial Intelligence (AI) system to provide a mapping from received sensor data from the one or more sensors 30 to estimated pressure data. The estimated pressure data is representative of the pressure applied by the peristaltic pump to the fluid. This can provide an indirect estimate of fluid pressure without the need for direct contact between a sensor and the pumped fluid, when the system is in use.

Training data may be prepared for the Artificial Intelligence (AI) system by utilizing the peristaltic pump to pump fluid and measuring the output pressure of the fluid. In this training data generation scenario, the sterility of the fluid is not important, since the system can be used purely to generate training data, and not to irrigate a site in a patient's body. The measured output pressure may be associated with data from the one or more sensors 30. A model may be created for predicting the measured output data from the data from the one or more sensors 30. In other words, the model may provide a mapping from the sensor data to the output pressure data.

In use of the system (for example, to irrigate a site in a patient's body), the model may be used with input data received from the one or more sensors 30 to provide an estimate of the output pressure of the peristaltic pump.

Any Artificial Intelligence (AI) system known in the art may be used for this purpose. For example, in an embodiment, a neural network may be used. The neural network (for example, a multi-layer perceptron) may be trained (for example, by back-propagation or other stochastic gradient descent method) using input data derived from the data provided by the one or more sensors 30 and target data derived from the output pressure data. In some embodiments, the neural network may be a recursive neural network.

The input data may be derived from the data provided by the one or more sensors 30 with or without pre-processing. The pre-processing may involve some form of normalization. Alternatively, or additionally, the pre-processing may involve a temporal modification such as filtering, for example low-pass filtering. Alternatively, or additionally, the pre-processing may involve a conversion into the frequency domain to produce. The output pressure data may also be pre-processed, either in the same way or in a different way.

Figure 4:
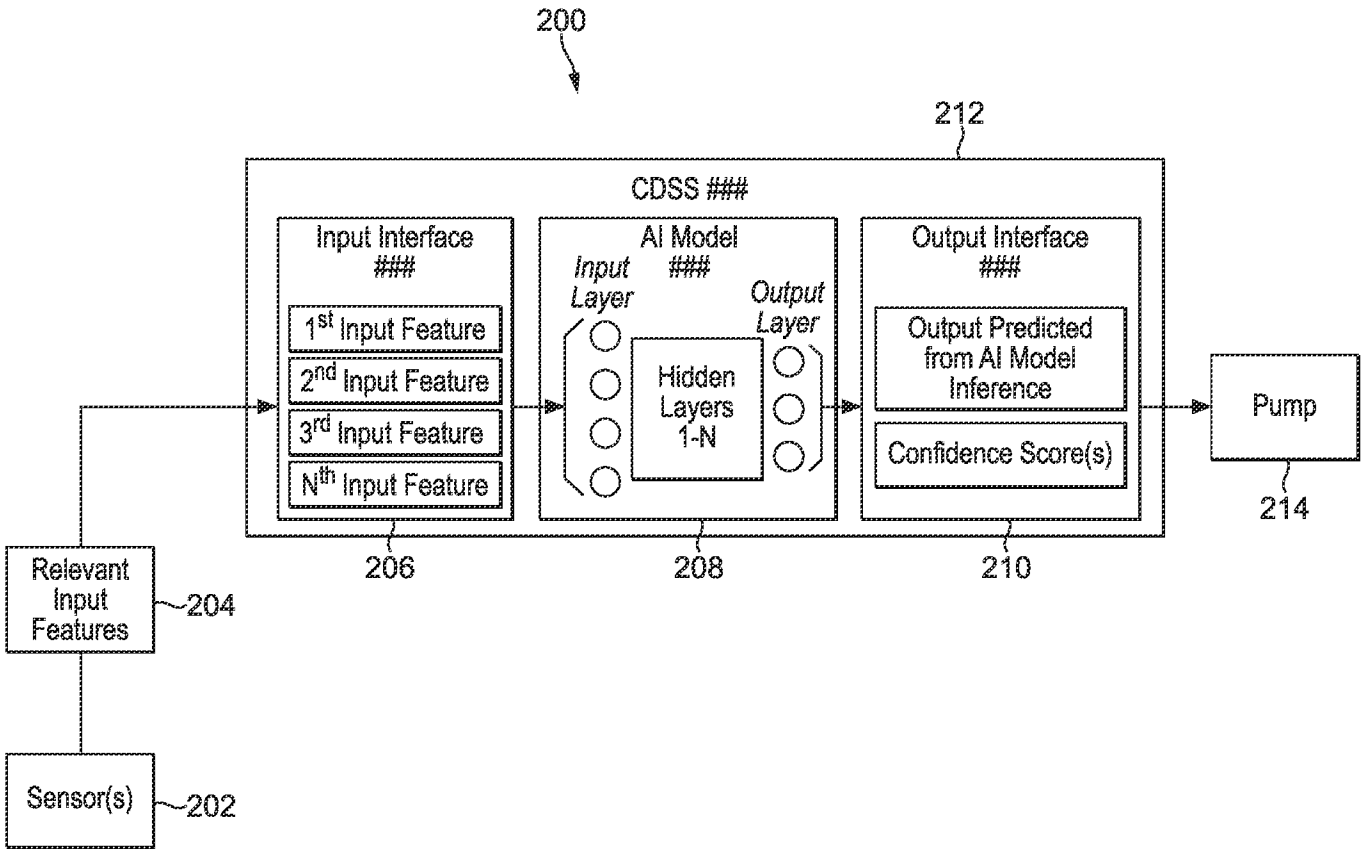
FIG. 4 illustrates a schematic overview of a pump measurement system incorporating an AI system.

By way of example only, FIG. 4 shows a schematic overview of a system 200 from a data perspective. This shows the system 200 ready for use (i.e., pre-trained). The system 200 comprises: sensor(s) 202; optional pre-processing unit 204; Artificial Intelligence system 212; and the pump 214. Each of blocks 204, 206, 208, 210, and 212 may be implemented in software or hardware.

Sensor(s) 202 may be the one or more sensors 30 described above, providing an output that is indicative of the output pressure of the pump 214, but is not necessarily directly proportional to the output pressure of the pump 214.

Optional pre-processing unit 204 may be provided to modify the output of the sensors 26 to provide data suitable for use as the input to the Artificial Intelligence system 212. For example, the sensor output data from each sensor 30 may be scaled to lie between 0 and 1.

The Artificial Intelligence system 212 receives an input, either directly from the sensor(s) 202 or from the optional pre-processing unit 204.

The Artificial Intelligence system 212 may form an input vector 206 from the received input. The input vector may include a value corresponding to one or more of the sensor (s) 202 for a given time, or may include multiple values spaced apart in time from one or more of the sensor(s) 202.

An Artificial Intelligence model 208 maps the input vector 206 (indicative of the sensor data from sensors 202) to an output 210 (indicative of the corresponding output pressure of the pump 214).

The Artificial Intelligence system 212 may form an input vector 206 from the received input.

In some embodiments, output 210 may simply be a scalar value indicating the output pressure of the pump 214. In some embodiments, the output value may be expressed along with a confidence score or range.

Pump 214 takes an input that is used to set the speed of the pump 214 and so directly influence the output pressure of the pump 214. In the present case, that input is the estimated current pressure taken from the output 210 of the Artificial Intelligence system 212. The control system of the pump 214 may compare the estimated pressure with a desired pressure (for example set by a user such as a physician), to determine by how much to increase or decrease the speed of the pump 214.

While there has been shown and described what is considered to be embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

The invention claimed is:

1. A peristaltic pump system comprising:

a peristaltic pump comprising:

a rotor, a track, a biasing material configured to apply a biasing force in a first direction to the track to resiliently bias the track towards the rotor to compress a flexible tube between the track and the rotor during operation of the pump, at least one sensor configured to measure movement of the track relative to the rotor during operation of the peristaltic pump and to output a signal indicative of a movement of the track; and a controller comprising hardware at least indirectly in communication with the at least one sensor, the controller being configured to determine fluid pressure in the tube based on the signal from the at least one sensor;

wherein the at least one sensor directly measures the movement of the track in a second direction against the biasing force, the second direction being opposite to the first direction; and the at least one sensor is entirely disposed outside of the track.

2. The peristaltic pump system according to claim 1, wherein the at least one sensor comprises at least one of a force gauge, a strain gauge, a piezoelectric sensor, an inductive sensor or an optical displacement sensor.

3. The peristaltic pump system according to claim 1, wherein the biasing material comprises at least one of a mechanical spring, a compressible block and a gas spring.

4. The peristaltic pump system according to claim 1, wherein the biasing material is located between the track and a cover member.

5. The peristaltic pump system according to claim 1, wherein the at least one sensor is associated with the biasing material.

6. The peristaltic pump system according to claim 1, wherein the at least one sensor is arranged between the track and a fixed part of the peristaltic pump.

7. The peristaltic pump system according to claim 1, wherein the controller is further configured to control operational parameters of the pump based on the signal from the at least one sensor.

8. The peristaltic pump system according to claim 1, wherein the controller is configured to incorporate the use of an artificial intelligence (AI) system configured to determine fluid pressure in the tube at least indirectly based on the signal output from the at least one sensor.

9. The peristaltic pump system according to claim 1, wherein an entirety of the track is moveable relative to the rotor and the at least one sensor is configured to measure movement of the entirety of the track relative to the rotor during operation of the peristaltic pump.

10. The peristaltic pump system according to claim 1, wherein an entirety of the track is rigid.

11. A method of fluid pressure measurement in a peristaltic pump, the peristaltic pump having a rotor and a track, the method comprising:

applying a biasing force in a first direction to the track to resiliently bias the track towards the rotor of the peristaltic pump to compress a flexible tube between the track of the peristaltic pump and the rotor during operation of the peristaltic pump, measuring movement of the track relative to the rotor during operation of the peristaltic pump from a position entirely outside the track, the measuring directly measures the movement of the track in a second direction against the biasing force, the second direction being opposite to the first direction, and determining fluid pressure in the tube based on the measured movement of the track.

12. The method according to claim 11, wherein the measuring comprises measuring with at least one sensor comprising at least one of a force gauge, strain gauge, piezoelectric sensor, inductive sensor or optical displacement sensor.

13. The method according to claim 11, wherein the resiliently biasing comprises resiliently biasing the track with at least one biasing material comprising at least one of a mechanical spring, compressible block or gas spring.

14. The method according to claim 11, further comprising altering an operational parameter of the peristaltic pump in response to the determined fluid pressure.

15. The method according to claim 11, further comprising providing at least one displacement sensor associated with the biasing device.

16. The method according to claim 11, wherein the measuring comprises providing at least one sensor arranged between the track and a fixed part of the pump.

17. The method according to claim 11, wherein the determining comprises using an artificial intelligence (AI) system trained to provide a mapping between the measured movement of the track relative to the rotor during the operation of the peristaltic pump and pressure data.

18. The method according to claim 11, wherein the resiliently biasing the track comprises resiliently biasing an entirety of the track towards the rotor and the measuring comprises measuring movement of the entirety of the track relative to the rotor during operation of the peristaltic pump.

19. The method according to claim 11, wherein an entirety of the track is rigid.

* * * * *